US012601562B1

(12) United States Patent
Ding et al.

(10) Patent No.: US 12,601,562 B1
(45) Date of Patent: Apr. 14, 2026

(54) BARREL NUT HANDGUARD SYSTEM

(71) Applicant: Leapers, Inc., Livonia, MI (US)

(72) Inventors: Tai-lai Ding, Northville, MI (US); Cody M. Schulz, Commerce Township, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 19/276,183

(22) Filed: Jul. 22, 2025

(51) Int. Cl.
*F41C 23/16* (2006.01)

(52) U.S. Cl.
CPC ..... *F41C 23/16* (2013.01)

(58) Field of Classification Search
CPC ..... F41C 23/16
See application file for complete search history.

(56) References Cited

U.S. PATENT DOCUMENTS

| | | | | |
|---|---|---|---|---|
| 8,141,289 | B2 * | 3/2012 | Gomez | F41C 23/16 42/90 |
| 8,347,540 | B2 * | 1/2013 | Sirois | F41C 27/00 42/72 |
| 8,739,448 | B2 * | 6/2014 | Kimmel | F41C 23/16 42/72 |
| 8,904,691 | B1 * | 12/2014 | Kincel | F41C 23/16 42/71.01 |
| 9,157,697 | B2 * | 10/2015 | Leclair | F41C 23/16 |
| 9,389,043 | B1 * | 7/2016 | Zhang | F41C 23/16 |
| 9,464,865 | B2 * | 10/2016 | Shea | F41C 23/16 |
| 9,513,083 | B1 | 12/2016 | Oglesby | |
| 9,599,430 | B1 * | 3/2017 | Geissele | F41C 23/16 |
| 9,791,239 | B1 * | 10/2017 | Kincel | F41A 21/485 |
| 9,909,836 | B2 * | 3/2018 | Galletta, II | F41A 21/48 |
| 10,126,095 | B1 * | 11/2018 | Reid | F41A 21/48 |
| 10,145,648 | B1 * | 12/2018 | Holder | F41C 23/16 |
| 10,309,747 | B2 * | 6/2019 | Samson | F41A 21/48 |
| 10,401,122 | B2 * | 9/2019 | Williams | F41G 11/003 |
| 10,436,549 | B1 * | 10/2019 | Taylor | F41C 23/16 |
| 10,619,971 | B2 * | 4/2020 | Hubbell | F41C 23/16 |
| 11,796,282 | B1 | 10/2023 | Ding et al. | |

(Continued)

FOREIGN PATENT DOCUMENTS

| | | | | |
|---|---|---|---|---|
| CZ | 303588 | B6 * | 12/2012 | F41C 23/16 |
| EP | 4467918 | A1 * | 11/2024 | F41C 23/16 |

(Continued)

*Primary Examiner* — Gabriel J. Klein
(74) *Attorney, Agent, or Firm* — Warner Norcross + Judd LLP

(57) ABSTRACT

A barrel nut handguard system can include a handguard with a sidewall defining a bridge opening extending to a handguard interior, a barrel nut defining a registration groove around a periphery of the barrel nut, and a connector bridge in the bridge opening so that a contact surface engages the first registration groove. A fastener extending between the connector bridge and handguard can be tightened so the barrel nut is clamped between the contact surface and the handguard interior. The contact surface can fit between walls of the registration groove and prevent fore to aft sliding of the handguard relative to the barrel nut. The barrel nut can include tool lands allowing tooled rotation of the barrel nut relative to a receiver of a firearm to secure a barrel to the receiver with the barrel nut, without requiring rotational indexing of the barrel nut relative to the receiver.

7 Claims, 6 Drawing Sheets

(56) References Cited

U.S. PATENT DOCUMENTS 12,146,725 B2 * 11/2024 Olsen ..... F41C 23/16
12,203,725 B2 * 1/2025 Boomgaarden ..... F41C 23/16
12,313,373 B2 * 5/2025 Underwood ..... F41A 21/48
2007/0261285 A1 * 11/2007 Troy ..... F41C 23/16 42/75.03
2011/0126443 A1 * 6/2011 Sirois ..... F41C 27/00 42/90
2011/0192066 A1 * 8/2011 Kimmel ..... F41C 23/16 42/71.01
2011/0239513 A1 * 10/2011 Sandman ..... F41C 23/16 29/525.01
2011/0247254 A1 * 10/2011 Barnes ..... F41A 21/48 42/75.01
2012/0042557 A1 * 2/2012 Gomez ..... F41C 23/16 42/90
2014/0000142 A1 * 1/2014 Patel ..... F41A 11/02 42/14
2014/0373419 A1 * 12/2014 Leclair ..... F41C 23/16 42/71.01
2015/0316347 A1 * 11/2015 Shea ..... F41C 23/16 42/75.02
2017/0059273 A1 * 3/2017 Geissele ..... F41C 23/16
2017/0160048 A1 * 6/2017 Galletta, II ..... F41A 21/48
2018/0023919 A1 * 1/2018 Kincel ..... F41C 23/16 42/71.01
2018/0202757 A1 * 7/2018 Samson ..... F41A 21/48
2018/0306551 A1 * 10/2018 Reid ..... F41A 21/485
2018/0356181 A1 * 12/2018 Williams ..... F41C 23/16
2019/0101355 A1 * 4/2019 Hubbell ..... F41C 23/16
2019/0154395 A1 * 5/2019 Kincel ..... F41G 11/003
2019/0277598 A1 * 9/2019 Kincel ..... F41A 5/18
2022/0018629 A1 * 1/2022 Senff ..... C07D 405/14
2023/0221092 A1 * 7/2023 Underwood ..... F41A 21/48 42/71.01
2023/0324140 A1 * 10/2023 Olsen ..... F41A 3/66 42/72
2024/0003654 A1 * 1/2024 Boomgaarden ..... F41C 23/16
2024/0418478 A1 * 12/2024 Muska ..... F41C 23/16
2025/0164208 A1 * 5/2025 Cogan ..... F41C 23/16

FOREIGN PATENT DOCUMENTS

KR 20200095306 A * 8/2020 ..... F41G 11/001
WO WO-2025155663 A1 * 7/2025 ..... F41C 27/00

* cited by examiner

BARREL NUT HANDGUARD SYSTEM

BACKGROUND OF THE INVENTION

The present invention relates generally to firearm accessories, and more particularly to systems and methods for securing a handguard to a firearm barrel nut in a manner that provides a robust, secure, and repeatable attachment without requiring rotational indexing or timing of the barrel nut.

In modern sporting rifles, particularly those based on the AR-platform, the handguard is a critical component that provides the user with a means to grip the firearm, mount accessories, and protect the support hand from the heat of the barrel. Secure attachment of the handguard to the upper receiver or barrel nut is essential to maintain accuracy, stability, and reliable operation of mounted accessories such as sights, lasers, and bipods.

Traditionally, many handguard mounting systems rely on a barrel nut that must be rotationally indexed, or "timed," to align with features on the upper receiver or handguard mounting mechanism. This process often involves tightening and loosening the barrel nut multiple times to achieve correct alignment with specific notches, ports and the gas tube, adding complexity, time, and the potential for over-torque or under-torque during installation. Improper timing can lead to handguard misalignment, reduced clamping force, or even damage to the firearm components.

Furthermore, many known systems utilize clamp-on methods or screw interfaces that do not ensure repeatable or mechanically secure engagement between the handguard and the barrel nut. Such configurations can result in loosening under recoil, shifts in accessory zero, or damage to the receiver threads or mounting surfaces over time.

Therefore, there is a need for a handguard attachment system that enables a secure, stable, and user-friendly connection to the barrel nut, without requiring the barrel nut to be rotationally timed or aligned, and that ensures positive engagement under operational stresses.

SUMMARY OF THE INVENTION

A barrel nut handguard system can include a handguard with a sidewall defining a bridge opening extending to a handguard interior, a barrel nut defining a registration groove around a periphery of the barrel nut, and a connector bridge in the bridge opening so that a contact surface engages the registration groove.

In one embodiment, a fastener can extend between the connector bridge and handguard. The fastener can be tightened so the barrel nut is clamped between the contact surface and the handguard interior.

In another embodiment, the contact surface can fit between walls of the registration groove and prevent fore to aft sliding of the handguard relative to the barrel nut.

In still another embodiment, the barrel nut can include tool lands allowing rotation of the barrel nut with a tool relative to a receiver of a firearm to secure a barrel to the receiver with the barrel nut, without requiring rotational indexing, clocking or timing of the barrel nut relative to the receiver and/or a gas tube.

In yet another embodiment, the barrel nut can include a midline bisecting the barrel nut in an upper portion and a lower portion. The registration groove can extend within the upper portion and the lower portion. The contact surface can engage the registration groove in the lower portion or the upper portion.

In even another embodiment, the fastener can be a bolt having a head and a threaded shaft and a length that extends along a fastener longitudinal axis. The length can span above and below the midline of the barrel nut when the first fastener engaged the first bridge connector.

In a further embodiment, the fastener can be oriented vertically relative to the handguard and/or the receiver of the firearm and configured to bias the connection bridge into engagement with the barrel nut at the registration groove.

In another further embodiment, the handguard can include a first shoulder extending from the sidewall and configured to receive a vertically extending first fastener.

In still a further embodiment, a second shoulder can extend from the sidewall and can be configured to receive a vertically extending second fastener, the second fastener being distal from the first fastener. The barrel nut can include a second registration groove around the periphery of the barrel nut.

In yet a further embodiment, a second contact surface, for example a ramped surface or other contour, can be joined with the first connector bridge and configured to engage the second registration groove in the lower portion of the barrel nut below the midline. The connector bridge can be oriented for engagement by the second fastener such that when the second fastener is tightened, the barrel nut is clamped between a second ramped surface of the connector bridge and the interior of the handguard.

The current embodiments provide a barrel nut handguard system that eliminates the need for barrel nut timing. The system can provide a secure mechanical interface using round and other contours in mating surfaces. The system can offer improved clamping stability via top-down or top-up vertically oriented fasteners. The system can be simple to install and service without specialized tools or alignment procedures.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
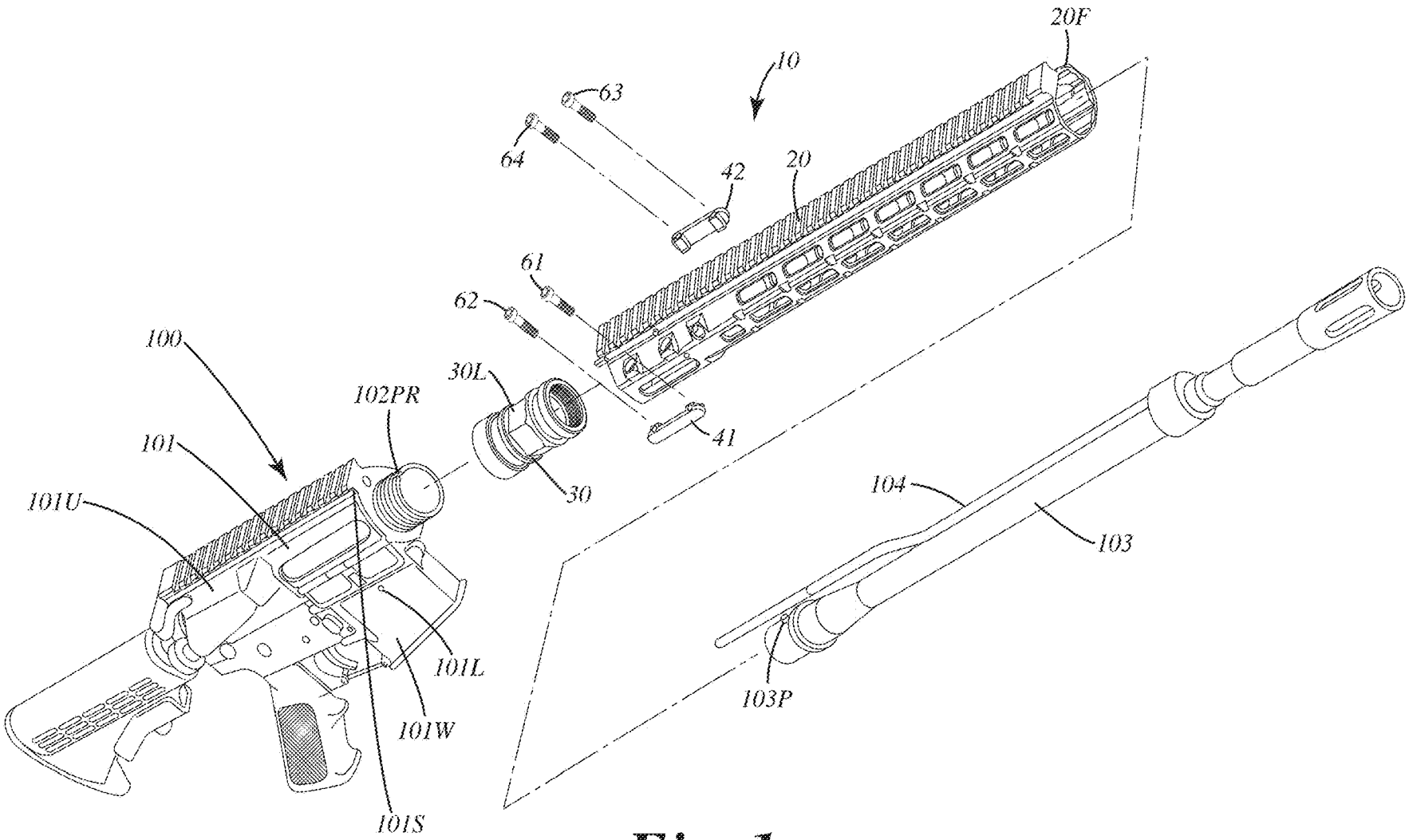
FIG. 1 is a perspective view of the barrel nut handguard system installed on firearm and receiver of a current embodiment.

A current embodiment of the barrel nut handguard system is illustrated in FIGS. 1-6 and generally designated 10. The system 10 can secure a handguard 20 to a receiver 101 associated with a firearm 100. The firearm 100 can be a conventional modern sporting, military or hunting rifle, for example, any AR-15, M16 and M4, available from a variety of manufacturers in varying configurations, and variants thereof and other firearm systems that include a barrel and a handguard, and a barrel nut or similar attachment component that secures a barrel 103 to the receiver 101. Some other examples of suitable firearms can include the FN SCAR, FN Minimi and M249 SAW commercially available from FN Herstal of Herstal, Belgium, HK416 and HK417 commercially available from Heckler & Koch of Oberndorf, Germany, the SIG Sauer MCX, commercially available from SIG Sauer, of Newington, New Hampshire, the Steyr AUG, commercially available from Steyr Arms of Steyr Austria, the Barrett REC7 commercially available from Barrett Firearms Manufacturing of Murfreesboro, Tennessee, and the Ruger AR-556 and SR-556 commercially available from Sturm, Ruger & Co. of Southport, Connecticut.

Figure 4:
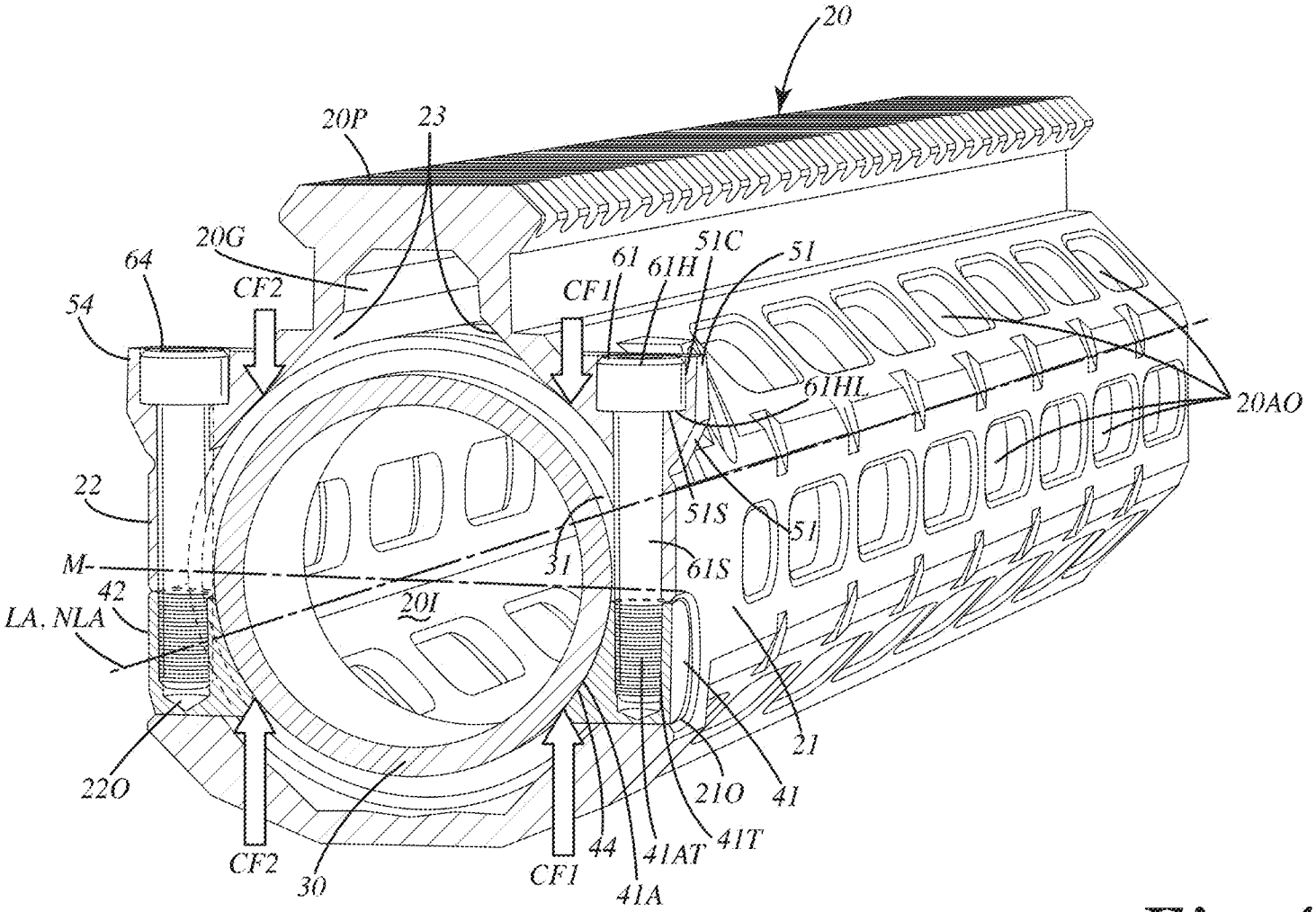
FIG. 4 is a section view of the system showing the vertical fasteners installed in the respective bridge connectors and being tightened to exert a clamping force on the barrel nut to secure the handguard to the barrel but without having to index the barrel nut relative to the receiver or other elements of the firearm taken along lines 4-4 in FIG. 3.

The system 10 can include a barrel nut 30 that threads onto a threaded base 102 of the receiver 101 to secure a barrel 103 to the receiver 101 and thus the firearm 100. The system 10 can provide a secure handguard to barrel nut connection utilizing a barrel nut 30 that does not need to be timed or clocked relative to a gas tube 104 or the receiver 101. As shown, the system 10 can include one or more connector bridges 41, 42 that extend through openings 210, 220 defined by the sidewalls 21, 22 of the handguard. The bridges 41, 42 can include contact surfaces that can register in or contact parts of the registration grooves 31, 32 defined by the barrel nut 30. Fasteners 61-64 optionally can apply upward tension between the heads of the fasteners and the bridges 41, 42, which can translate into clamping forces CF1 and CF2 as shown in FIG. 4 to clamp the barrel nut 30 between the interior surfaces 23 of the handguard and the contact surfaces 41A-41D of the bridges 41, 42. This in turn results in a secure connection of all components relative to one another and an associated receiver of the firearm, optionally without ever having to index, clock or time the barrel nut relative to the receiver 101 of the firearm.

Turning now to FIGS. 1-6, the system 10 and components of the firearm 100 will now be described in further detail. To begin, the receiver 101 can be a portion of a firearm 100. The receiver optionally can include a magazine well 101W and a trigger guard 100G, as well as an upper receiver 101U and a lower receiver 101L. The receiver 101 can include a front surface 101F. The front surface 101F can extend forward of the magazine well 101W. The front surface can be substantially planar, but in some circumstances can be contoured to reflect or mimic a similar contour on the rear edge of the handguard. The front surface 101F can include a base 102 that extends forwardly from the front surface 101F. The base 102 can be substantially cylindrical as illustrated, but optionally can be other geometric shapes. The base 102 can include a threaded outer surface configured for mating with internal threads 30T of the barrel nut 30 as described below. The cylindrical base 102 also can define a pin recess 102PR. This pin recess 102PR can extend rearwardly from a front edge 102F of the base 102 a preselected distance, but generally does not extend all the way rearward to the front surface 101F of the receiver.

The system 10 can join a barrel 103 with the receiver 101 to make the firearm 100. The barrel 103 can include a muzzle 103M and a receiver end 103R. The receiver end 103R can be configured to be inserted on and/or into the bore defined by the base. The barrel can include a barrel ring 103B that is adjacent the receiver end 103R so that the receiver end 103R is placed consistently and precisely within the base 102 and the remainder of the receiver 101. In this manner, it can interact properly with components therein and ammunition fed into the barrel 103. The barrel in some cases can include a barrel indexing pin 103P that fits in the pin recess 102PR when the barrel 103 is fully installed relative to the receiver. This indexing pin, when registered in the pin recess, properly indexes the barrel relative to the receiver.

Figure 2:
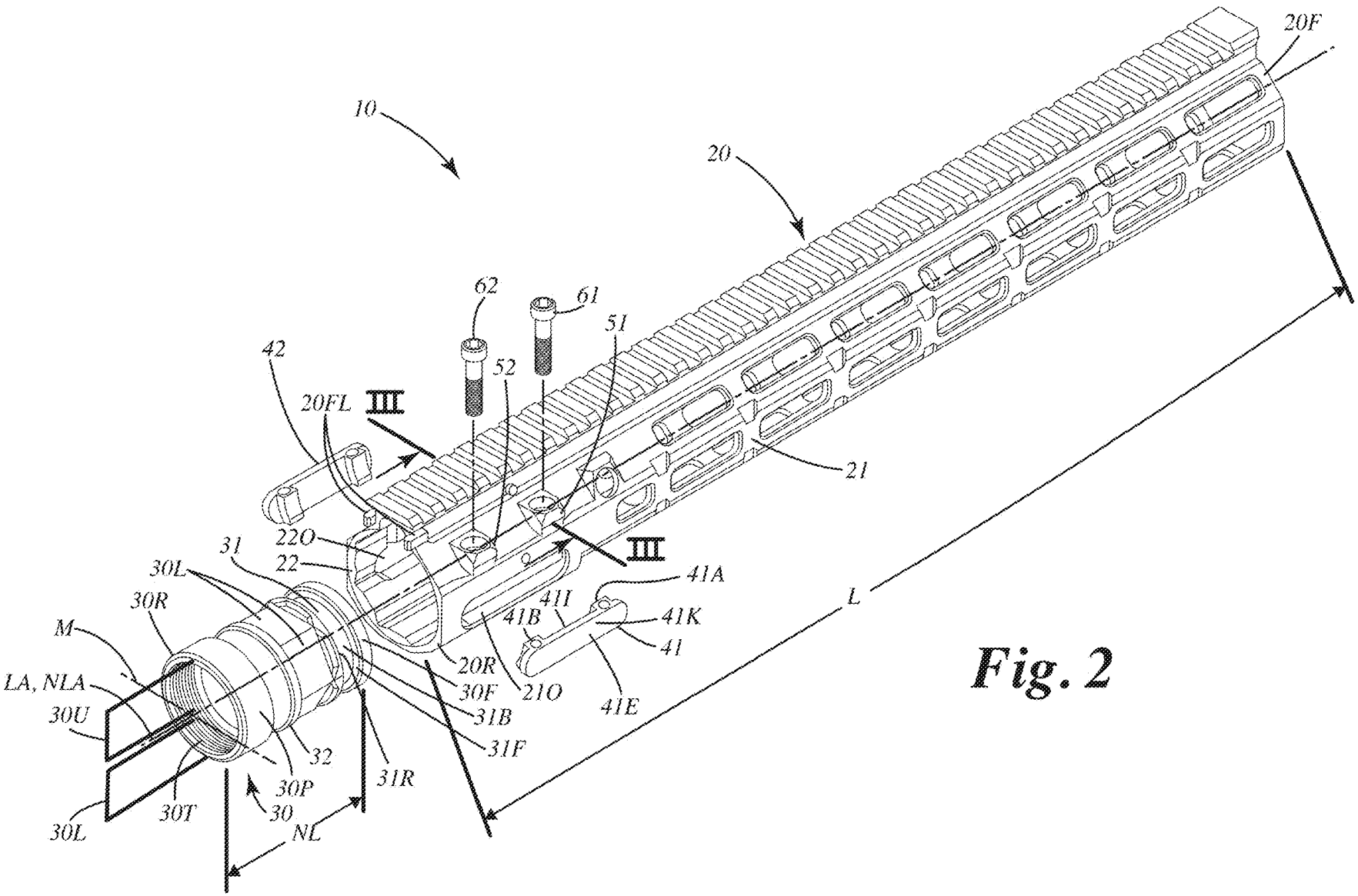
FIG. 2 is a perspective exploded view of the barrel nut handguard system removed from the firearm.

With reference to FIG. 2, the system 10 can include the barrel nut 40 which can define a threaded internal bore 30 that mates with the receiver base 102. The barrel nut 30 can include an exterior surface that it substantially cylindrical but could be of other geometric shapes. A portion of the exterior surface, for example, can be polygonal, such as octagonal or hexagonal, and can include lands 30L. These lands can be flat or planar, can be configured to be engaged by a tool, such as a box end wrench or crows foot, but of course can be substituted with ridges or other features that can mate with a correspondingly shaped tool which can be used to rotate the barrel nut, tightening or loosening it relative to the longitudinal axis LA and/or the receiver to secure or remove the barrel, elliptical or some other shape depending on the application and the configuration of the handguard 20. The barrel nut 30 can include a rear surface 30R and an opposing front surface 30F.

Figure 3:
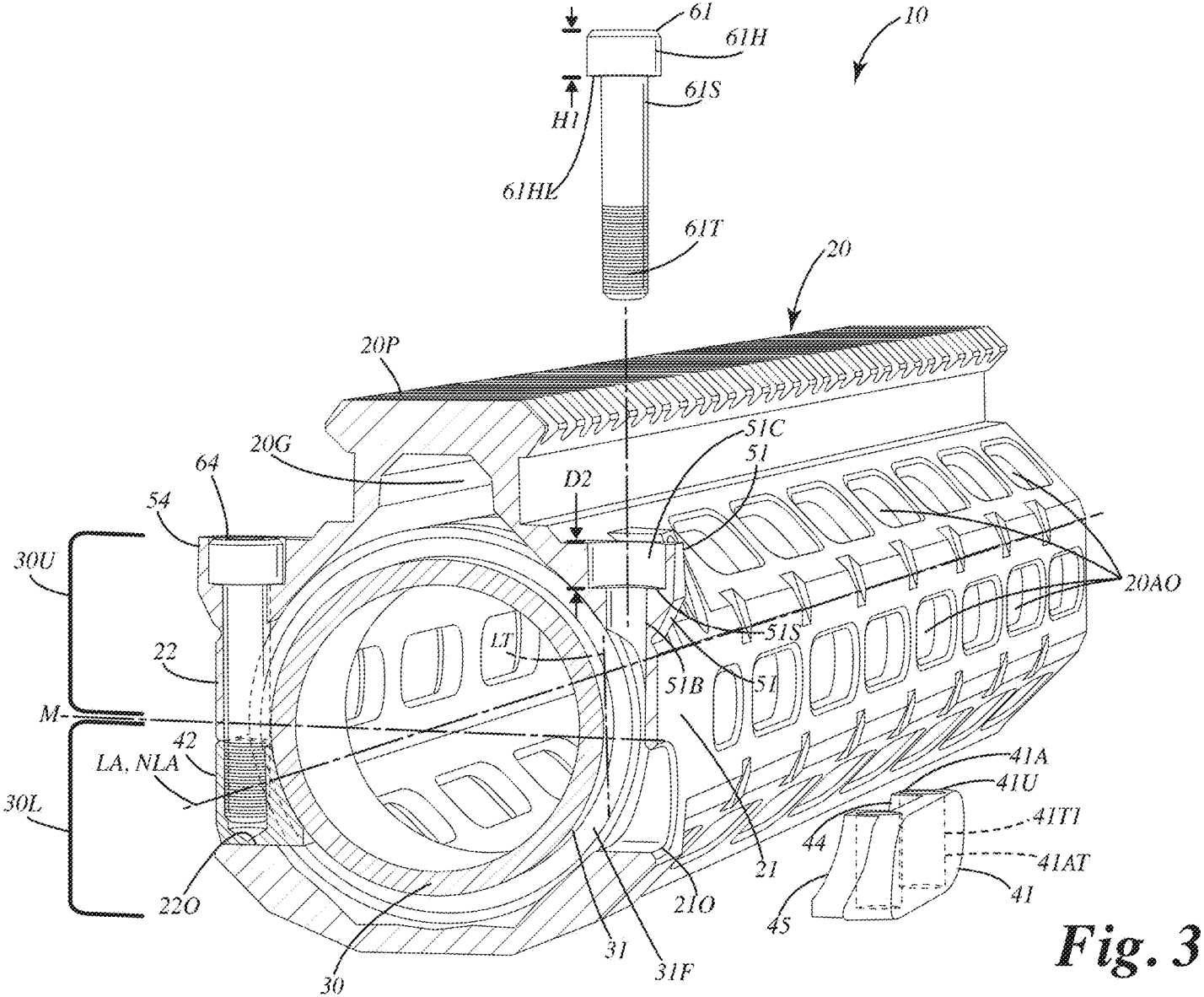
FIG. 3 is a section view of the system showing a shoulder, a vertical fastener installed in a bridge connector, a vertical fastener about to be installed through the shoulder, and a bridge connector about to be installed in a bridge opening, taken along lines 3-3 in FIG. 2.

Referring to FIGS. 2-4, the barrel nut 30 can include a midline M bisecting the barrel nut into an upper portion 30M and a lower portion 30L. The barrel nut can be sized to be positioned in the handguard interior 201 adjacent the barrel 103 when the system is assembled on the firearm 100. The barrel nut 30 can fit in the interior closely, with minor tolerances so that the handguard can be clamped to the barrel nut as described below. Further, with the system 10 described herein, it will be appreciated that the barrel nut can be tightened, that is the threads 30T can engage the threads on the base 102 to any satisfactory degree to secure the barrel 103 to the receiver 101. Optionally, the barrel nut need not be timed, clocked or indexed so that it aligns in any particular manner with the receiver 101 like conventional barrel nuts, which frequently must be perfectly indexed or aligned with the receiver, sometimes also providing perfect alignment so that a gas tube 104 can extend to the receiver 101. Further optionally, with the present system, the barrel nut stays out of the way of the gas tube and need not be indexed relative to the receiver or any other component when tightened down to secure the barrel to the receiver.

Figure 5:
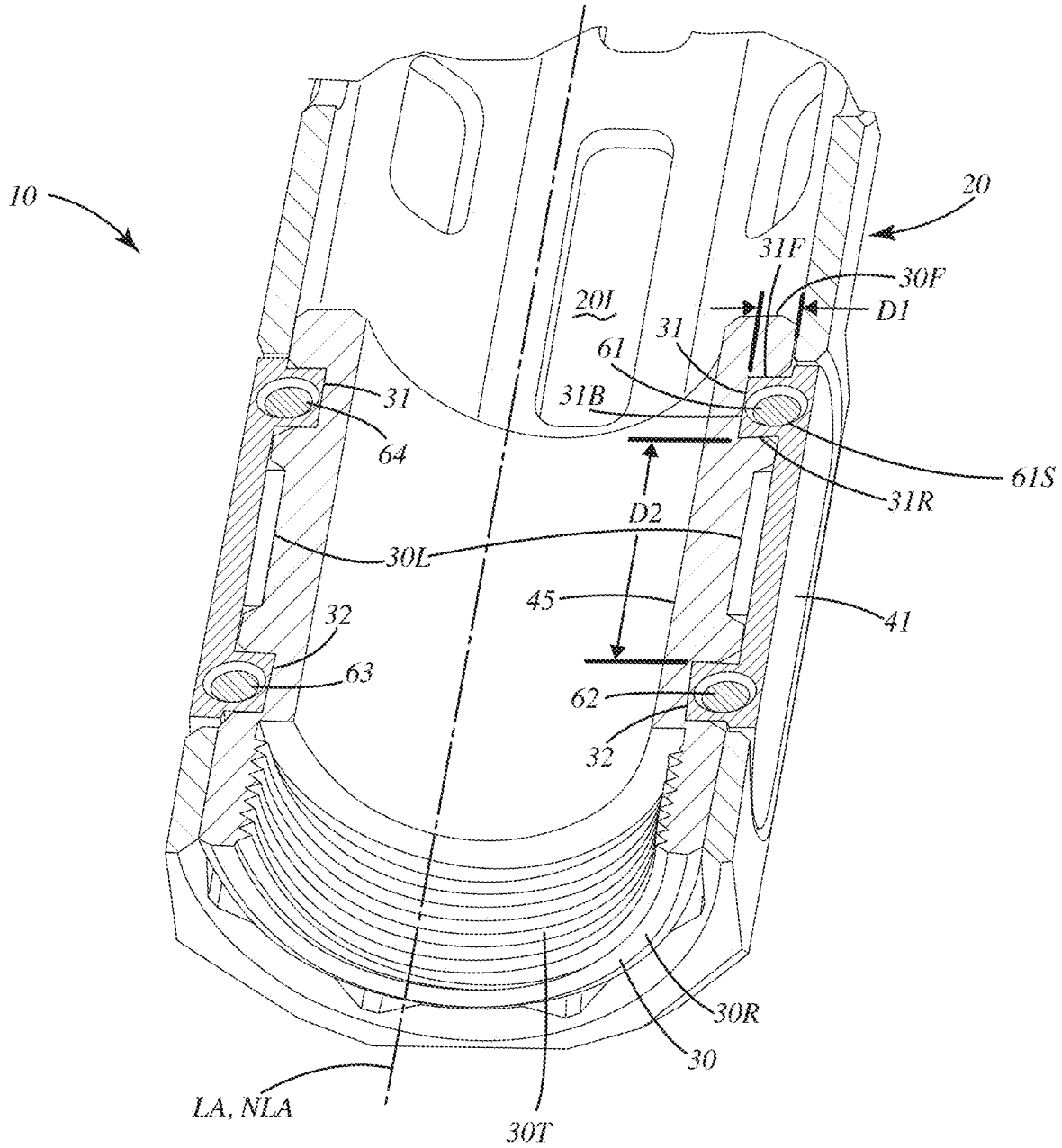
FIG. 5 is a section view of the system showing the fasteners in the respective registration grooves taken along lines 5-5 in FIG. 3.
Figure 6:
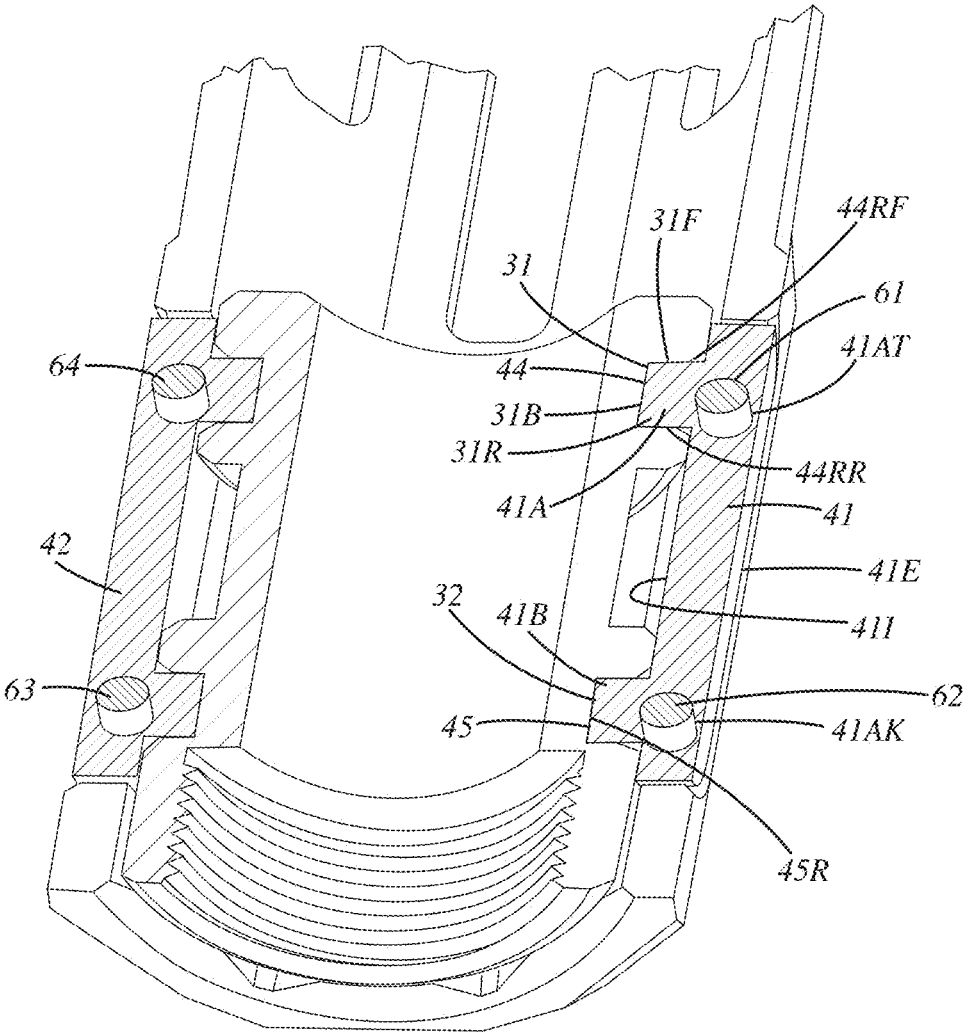
FIG. 6 is a section view of the system showing the fasteners in the respective registration grooves taken along lines 6-6 in FIG. 3.

As shown in FIGS. 2, 5 and 6, the barrel nut can define one or more registration grooves 31 and 32 that can optionally extend entirely around the longitudinal axis LA 360 degrees, generally around a periphery 30P of the barrel nut. These grooves can be similar or identical to one another except regarding the placement. For example, the first registration groove 31 can be defined in the exterior surface closer to the front 30F of the barrel nut 30 than the second registration groove 32. The second registration groove 32 can be defined in the exterior surface of the barrel nut closer to the rear 30R of the barrel nut 30 than the first registration groove 31. Each of the grooves can be inset relative to the respective first and second edges. Tool lands 30L can be disposed optionally between the first registration groove 31 and the second registration groove 32 such that the registration grooves flank the tool lands forward and rearward thereof. Although not shown, the first registration groove 31 and second registration groove 32 can be merged into a single large groove that is disposed forward or rearward of the lands 30L or some other tool engagement portion of the barrel nut depending on the configuration of the lands. The use of two or more registration grooves can in some cases offer a different level of securement than a single groove.

Given the similarity of the registration grooves, only the first registration groove 31 will be described here. The first registration groove 41, as shown, can extend completely around the exterior surface and periphery 30P, however, optionally, it can be interrupted by one or more regularly or irregularly placed portions of the periphery 30P so that the groove is in segments. The registration groove 31 shown in FIGS. 1, 5 and 6 can include a first forward wall 31F, a first bottom wall 31B, and a first rearward wall 31R. The first forward wall 31F and first rearward wall 31R can extend away from the first bottom wall 31B a distance D1 which can correspond to the depth of the first registration groove 31. This depth can be set to correspond to certain contact surfaces of the connection bridges as described below allowing adequate engagement of those connection bridges with the groove and optionally the bottom wall 31B of the groove. Of course, the contact surfaces of the bridges also can interact with the respective first forward wall and/or the first rearward wall to prevent relative sliding movement of the handguard 20 fore and aft along the longitudinal axis of the handguard or firearm or the nut longitudinal axis and LA. In turn, this can prevent or impair the handguard from sliding or moving away from the receiver, generally keeping the handguard well aligned with the receiver and any components thereon. Optionally, the second registration groove 32 can be similarly configured, with a forward wall, bottom wall and rearward wall. Further optionally, as described below, the contact surfaces can be disposed between the forward walls and the rearward walls so as to impair at least one of forward movement and rearward movement of the handguard relative to the barrel nut.

The bottom wall 31B of the first registration groove 31 can extend circumferentially around the nut longitudinal axis 360°. The bottom wall generally can be of a cylindrical configuration, extending around that axis. Of course, in some applications, the bottom wall can include ridges, protrusions, recesses grooves or other contours and features to suitably engage the contact surfaces of the connector bridges 41 and 42 as described below.

Optionally, although the registration grooves are shown to include a U- or C-shaped square or rectangular channel configuration, the grooves can be of other geometric configurations. For example, when taking a cross-section, each groove can be polygonal, partially elliptical, rounded, partially circular, concave, or some other angled and/or rounded cross section.

The system, as shown in FIGS. 1-6, can include a handguard 20 which can be an elongated tube-like member. The handguard can be placed over the barrel 103 and generally over the barrel nut 30. The handguard can include a handguard interior 201 that extends along its length from one end to the other, in which the barrel can be disposed, and concealed from engagement. The handguard 20 can include a rear edge 20R and a front edge 20F. The rear edge 20R can form an engagement surface that is configured to mate against the front surface 101F of the receiver 101. The portion of the handguard near the rear edge can be referred to as the rear end of the handguard. The rear end can include anti-rotation flanges 20FL located on the left and right sides extending rearward a distance beyond the rear edge 20R of the handguard 20. When the handguard is fully installed, the anti-rotation flanges 20FL can be disposed immediately adjacent the receiver portion 101S. The flanges 20FL can engage the portion of the receiver 101 when a rotational force is exerted on the handguard about the longitudinal axis LA, the barrel, the barrel nut and/or the base. This engagement can impair or prevent the handguard 20 from rotating relative to the receiver 30, keeping the handguard 20 and everything mounted on the handguard from rotating out of a predetermined alignment with the receiver 101, in addition to the securement provided by the other components below.

The handguard 20 shown in FIGS. 2-4 can include one or more shoulders 51-54. These shoulders generally can be located toward the rear edge 20R of the handguard 20 so as to align and provide registration of one or more fasteners 61-64 that cooperatively interact with the barrel nut 30 and/or the respective first bridge connector 41 and second bridge connector 42. The shoulders can be generally similar or identical to one another so only the first shoulder 51 will be described in detail. As shown in FIGS. 3 and 4, the first shoulder 51 can be disposed above the midline M generally in the upper portion 30U of the handguard 20. The first shoulder 51 can be oriented along the length L of the handguard so that when the handguard 20 is installed relative to the barrel nut 30, the shoulder bore 51B extends at least partially through a portion of the handguard 20 and can be aligned with the first registration groove 31. The first shoulder bore 51B can receive a shaft 61S of the first fastener 61. The bore can further include a lip or shoulder 51S that projects outwardly away from the bore 51B within the shoulder 51. The shoulder 51S can be engaged by the head 61H of the fastener 61 when the fastener is installed. The shoulder 51S can be engaged by the lower surface 61HL of the head 61H when the fastener 61 is tightened relative to the handguard and in particular the first connector bridge 41 as described below. The bore 51B can transition downward along the first sidewall 21 from the shoulder 51 which can be disposed along the sidewall 21. It will be appreciated that although the handguard 20 can include first and second sidewalls 21 and 22, these components can form a continuous singular sidewall of the handguard or can be divided up into one or more different sidewalls angled or curved relative to one another.

Optionally, the shoulder 51 can be constructed to include a cup 51C that is disposed above the shoulder 51S. This cup 51C can be of a depth D2 that is greater than the height H1 of the head 61H of the fastener 61. With this differential, the head 61H can be nested within and concealed at least partially within the cup 51C and in particular the shoulder 51 when the fastener 61 is fully installed. Although shown as projecting outward from the sidewalls of the handguard 20, the respective shoulders 51-54 alternatively can be constructed and formed as larger block like elements. For example, the shoulders 51 and 52 on one side of the handguard can be combined into a single solid shoulder, and the shoulders 53 and 54 on the other side can be combined as a single solid shoulder. Moreover, the shoulders might not be as pronounced and projecting outwardly from the respective sidewalls 21 and 22 as shown, in other applications.

Further optionally, the shoulders 51-54 can be disposed between a picatinny rail 20P that is disposed atop the handguard 20, and the midline M of the handguard. In some cases, the shoulders can also be disposed below a gas tube cavity 20G that extends along the handguard 20 under the picatinny rail to accommodate a gas tube 104 of the firearm 100. Of course, the shoulders can be placed elsewhere along or around the handguard in other applications.

As further shown in FIGS. 2-4 and mentioned above, the system 10 can include fasteners 61-64. These fasteners can be generally similar or identical, so only the first fastener 61 will be described here. As shown in FIG. 3, the first fastener can include a head 61H in a drive feature disposed in the head so that a tool can rotate or drive the fastener. The shaft 61S can project from a lower surface of the head 61HL. The shaft 61S can be largely unthreaded except for a threaded portion 61T at the lower end. That threaded portion 61T can mate with corresponding threaded apertures 41AT as shown in FIG. 6 in the connector bridge 41.

Optionally, as shown in all the figures, the fasteners can be vertically oriented and can extend along opposite sides of the barrel nut and barrel when the system is installed relative to a firearm 10. By vertically oriented, it is meant that the fasteners can be in a vertical configuration when the firearm is held in an upright ready to shoot orientation. Further, although shown in a configuration where the fasteners are generally oriented in a downward vertical configuration, with the heads higher than the threaded portions thereof, in some cases, the configuration of the shoulders and connector bridges as described below can be reversed such that the heads are below the threaded portion, and the fasteners generally extend upwardly instead of downwardly. Moreover, as can be seen in the figures, when the fasteners are installed, portions of their lengths can extend within the respective registration grooves, between the forward and rearward walls thereof. In some cases, the lengths of the fasteners can extend above and below the midline M. Further, a portion of each fastener can be disposed in the upper portion 30U and another portion of the fastener can be disposed in the lower portion 30L without the fastener extending across the longitudinal axis, for example, from a left side to a right side thereof.

As mentioned above, and shown in FIGS. 4-6, the system 10 can include one or more bridge connectors 41, 42. These bridge connectors can be disposed on opposite sides of the handguard 20 and arranged to engage the barrel nut to secure the handguard 20 to the barrel nut 30 in cooperation with the fasteners 61-64. As shown in FIGS. 2 and 3, the first sidewall 21 can define a first lateral opening 210 and the second lateral sidewall 22 can define a second lateral opening 220. These first and second lateral openings can also be referred to as bridge slots herein. The first lateral opening 210 can be an elongated slot which extends longitudinally and parallel to the longitudinal axis LA of the system 10 and/or handguard 20. The first lateral opening 210 can be longer than it is wide. The first lateral opening 210 and the second lateral opening 220 can be disposed optionally below the midline M of the handguard as shown in FIGS. 3 and 4. The lateral opening 210 can be sized and shaped differently than the remainder of the apertures 20AOL disposed along the sidewalls of the handguard 20 for connecting accessories to the handguard. The lateral opening 210 can be close enough to the rearward edge 20R of the handguard 20 so that it overlaps a substantial portion or a majority of the length NL of the nut 30. The lateral opening 210 as well as the other lateral opening 220 can also be disposed and located along the sidewalls so that when the handguard is installed relative to the barrel nut 30, the openings overlap both of the registration grooves 31 and 32 defined by the barrel nut 30.

Each of the lateral bridge openings or lateral slots 210 and 220 can be configured to receive the respective first bridge connector 41 and second bridge connector 42 therein. The bridge connectors 41 and 42 can be generally identical but mirror images of one another generally facing toward one another on opposite sides of the handguard 20 and the barrel 30. Due to their similar structure in nature, only the first bridge connector 41 will be described here in connection with FIGS. 2-6. The bridge connector 41 can include an exterior surface 41E and an interior surface 411. The interior surface 411 generally faces toward the interior 201 of the handguard and toward the barrel nut 30. The interior surface can include optional ramps or buttresses 41A and 41B that extend from a base 41K. The ramps can be distal from one another along the base 41K. The ramps can include, or form contact surfaces that can contact and/or engage the barrel nut within the first registration groove 31 and/or contact and/or engage the registration groove 31 itself. The base 41K optionally can remain outside of the registration grooves as the ramps project into the respective grooves. The respective ramped surfaces or contact surfaces 44 and 45 of the bridge connector 41 can engage the respective first registration groove 31 and second registration groove 32. Optionally, the first contact surface 44 can project into the first registration groove 31 as shown in FIG. 6. There, the contact surface 44 can directly contact and engage against the bottom wall 31B of the first registration groove 31. The forward surface 44RF of the ramp can be adjacent and/or engage the forward wall 31F of the groove. The rear surface 44R of the ramp can be adjacent and/or engage the rear surface 31R of the first registration groove 31. The second contact surface 45 can project into the second registration groove 32. The contact surface 44 can directly contact and engage against the bottom wall of the second registration groove 32. The forward surface of the ramp can be adjacent and/or engage the forward wall of that groove. The rear surface of the ramp can be adjacent and/or engage the rear surface of the second registration groove 32.

Optionally, the contact surfaces 44 and 45 can be of a curved or arcuate configuration as shown for example in FIGS. 3 and 4. Further optionally, the first contact surface 44 and second contact surface 45 can be shaped to mate with, engage and/or otherwise contact the respective registration grooves 31 and 32 and optionally the bottom walls of those registration grooves. Each of the surfaces 44 and 45 can be shaped and corresponding to a complimentary surface in or around the respective registration grooves. In other applications, these contact surfaces 44 and 45 can be in the form of a bump, ridge, protrusion, bar, or other contour along the respective ramps or buttresses 41A and 41B.

As shown in FIGS. 4 and 6, the contact surface 44 optionally contacts the barrel nut in the first registration groove below the middle line M of the barrel nut and handguard 20. The contact surfaces 44 and 45 can contact the bottom walls of the registration groove 31 and 32 respectively below and inward from a line of tangency LT that touches the exterior of the barrel nut 30 where the midline M extends through the barrel nut 30 as shown in FIG. 3. Contact can occur between the line of tangency and a vertical plane that passes through the axis LA. With the contact surface 44 and optionally the other contact surface 45 of the first bridge connector 41 contacting the barrel nut and in particular the respective registration grooves 31 and 32 below the midline M, these contact surfaces can cooperate with the interior surfaces 23 in the handguard 20 to exert clamping forces CF1 and CF2 against the barrel nut when the respective fasteners 61-64 are tightened relative to the bridge connectors 41 and 42 as described further below.

As shown in FIGS. 3-6, the first bridge connector 41 can include respective threaded apertures 41AT and 41AK. These threaded apertures can receive the threaded portions of the fastener 61 and 62 when installed relative to the first bridge connector 41. For example, the thread 61T of the first fastener 61 when installed as shown in FIG. 4 can threadably engage the threads 41T1 within the threaded aperture 41AT. When the first fastener 61 is tightened relative to the first connector bridge 41, the head 61H of the fastener can engage the shoulder 51 of the handguard 20. As the tightening continues, the thread 61T threads into the aperture 41AT. The shaft 61S comes under tension because it is being pulled between the aperture and the shoulder. As a result, the first connector bridge 41 is pulled upward toward the shoulder 51. As this occurs, the contact surface 44 engages the registration groove 31 and, for example, the bottom wall 31B of the registration groove. As the tightening continues, a clamping force CF1 is exerted between the interior surfaces 23 of the handguard and the contact surface 44, thereby clamping and/or pinching the barrel nut 30 therebetween. This in turn creates the clamping force that can prevent the handguard 20 from moving or rotating relative to the barrel nut.

As will be appreciated, the third 63 and fourth 64 fasteners can be tightened relative to the second bridge connector 42 in a manner similar to that described above with the first fastener 61 and second fastener 62 relative to the first lateral bridge 41. Upon such tightening, as shown in FIG. 4, a second clamping force CF2 can be exerted on the other side of the longitudinal axis LA of the system and handguard. In turn, the contact surfaces of the second bridge connector 42 can cooperatively exert that clamping force CF2 with the interior surfaces 23 of the handguard 20 on the barrel nut 30. This can further secure the handguard to the barrel nut in a fixed and non-rotatable manner, without ever having to index the barrel nut relative to the receiver and/or the handguard.

As shown in FIG. 5, the fasteners 61-64 can be disposed in the respective first registration groove 31 and second registration groove 32. Optionally, the fasteners pass only through a small portion of the respective registration grooves. For example, the fastener 61 passes tangentially through the registration groove 31 for a short distance. Optionally, the fastener 61 and the shaft does not contact the respective walls of the groove to exert any type of force on the groove via the fastener to move or force the handguard toward or away from the receiver. For example, the fastener shaft 61S might not contact the forward wall 31F, rearward wall 31R and/or bottom wall 31B of the first registration groove 31. Accordingly, the fastener 61 itself might not contact the groove directly. There may further be gaps or spaces between the shaft 61S and those respective walls.

With reference to FIG. 5, the contact surfaces 44 and 45 of the first bridge connector 44 can be separated a distance D2 from one another. This distance can correspond to the distance by which the respective first registration groove 31 is separated from the second registration groove 32. Within this distance D2, the tool lands 30 can be disposed when the first bridge connector 41 is installed relative to the registration grooves and in the barrel nut and handguard in general. Of course, in other constructions, the ramps, buttresses or contact surfaces 44 and 45 can be disposed different distances relative to one another. In some cases, these components can be immediately adjacent and/or contiguous with one another. In those applications, the registration grooves 31 and 32 however can be similarly configured so that the contact surfaces can fit within the grooves. When the contact surfaces are fit within the grooves, they can assist in exerting the clamping force in coordination with the interior surface or other components of the vanguard, but also optionally it can prevent fore to aft sliding or movement of the handguard relative to the barrel nut 30. This can occur when the forward and rearward surfaces of the respective contact surfaces engage the forward and rearward walls of the first and second registration grooves.

Although the bridge connectors 41 and 42 are illustrated as including multiple contact surfaces 44 and 45 that contact the respective registration grooves 31 and 32, those bridge connectors can be modified to include a single protrusion or contact surface that engages a single registration groove along the barrel nut 30. In other applications, multiple contact surfaces might be included along the connector bridge and those multiple contact surfaces can engage and nest within multiple registration grooves along the length NL of the barrel nut 30.

A method of installing the barrel nut handguard system 10 will now be briefly described. The system 10 can be offered in a kit including the handguard 20 the barrel nut 30, the respective first bridge connector 41 and second bridge connector 42, as well as the fasteners 61-64. A user can install that system via the kit relative to a firearm 100. As shown in FIGS. 1 and 2, a user can provide a firearm 100 and a barrel 103. The barrel can be installed relative to the receiver 101 by installing a portion of the barrel in the base 102. If included a barrel pin 103P can align with a pin recess 102PR on the receiver to align the barrel features with a receiver 101 and the base 102. A user can install a gas tube or other components relative to the barrel and/or the receiver. The user can place the barrel nut 30 over the barrel 103 and move it toward the base 102. The user can thread the threads 30T of the barrel nut onto the threads of the base 102. The user can use a tool and engage that tool with the lands 30L on the barrel nut 30. The user can rotate the barrel nut until sufficiently tight, however due to the configuration of the current embodiments, the user need not index time or clock the barrel nut to a specific angular rotation relative to the receiver and/or the barrel. In other words, the user can randomly tighten the barrel nut to any orientation relative to the base 102 and/or the receiver 101.

With the barrel nut 30 installed relative to the base 102 and the receiver 101, the user can place the handguard 20 over the barrel nut so that the barrel nut enters the interior 201 of the handguard. However, before so doing, the user can remove the fastener 61-64 as well as the first connector bridge 41 and second connector bridge 42. Thus, those elements will not interfere with movement of the rear face 20R of the handguard toward the front face 101F of the receiver 100. The user can engage that rear face 20R against the front face 101F. The flanges 20 FL can be disposed along opposite sides of the receiver to provide extra indexing of the handguard relative to the receiver and impairing relative rotation thereof.

The user can install the first connector bridge 41 in the first lateral opening 210, and the second connector bridge 42 in the second lateral aperture 220. The user can insert the respective fastener 61-64 in the respective shoulders 51-54 extending those fasteners to engage the apertures defined by the respective bridges 41 and 42. As the fasteners are installed, they can tangentially enter and extend within a portion of the respective first registration groove 31 and second registration groove 32. This can provide an initial securement of the handguard relative to the barrel nut so that it cannot be removed therefrom. However, to further secure the handguard and effectively clamp the handguard to the barrel nut, those fasteners can be tightened to exert the clamping forces CF1 and CF2 as described above, against the barrel nut to secure firmly and solidly the handguard 20 to the barrel nut 30 and thus to the receiver 101.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

Reference throughout this specification to "a current embodiment" or "an embodiment" or "alternative embodiment" means that a particular feature, structure, or characteristic described in connection with the embodiment is included in at least one embodiment herein. Accordingly, the appearance of the phrases "in one embodiment" or "in an embodiment" or "in an alternative embodiment" in various places throughout this specification are not necessarily all referring to the same embodiment. Additionally, the features, structures, or characteristics of one embodiment are contemplated for proper and full combination in any suitable manner in one or more other embodiments, which is fully contemplated herein. Further, features, structures, or characteristics of one embodiment or multiple embodiments are readily and completely mixed and matched with any features, structures, or characteristics of any other embodiment or multiple embodiments in varying combinations and permutations.

What is claimed is:

1. An apparatus configured to secure a handguard to a barrel nut of a firearm, the apparatus comprising:

a handguard including an elongated interior configured to fit over a barrel and a barrel nut of a firearm, the barrel including a barrel axis, the handguard including a first sidewall and an opposing second sidewall, with a first bridge slot defined by the first sidewall, the first bridge slot extending to the elongated interior and longitudinally along the handguard;

a first shoulder extending from the first sidewall and configured to receive a vertically extending first fastener;

a barrel nut including a midline bisecting the barrel nut into an upper portion and a lower portion, the barrel nut including a periphery, the barrel nut defining a first registration groove around the periphery of the barrel nut, the barrel nut sized to be positioned in the handguard interior adjacent the barrel; and a first connector bridge disposed in the first bridge slot, the first connector bridge including a first ramped surface configured to engage the first registration groove in the lower portion of the barrel nut below the midline, the first connector bridge oriented for engagement by the first fastener such that when the first fastener is tightened, the barrel nut is clamped between the first ramped surface and the elongated interior of the handguard, wherein the barrel nut includes a second registration groove distal from the first registration groove, wherein the first connector bridge includes a second ramped surface distal from the first ramped surface, wherein the second ramped surface is configured to engage an engagement surface within the second registration groove.

2. An apparatus configured to secure a handguard to a barrel nut of a firearm, the apparatus comprising:

a handguard including an elongated interior configured to fit over a barrel and a barrel nut of a firearm, the barrel including a barrel axis, the handguard including a first sidewall and an opposing second sidewall, with a first bridge slot defined by the first sidewall, the first bridge slot extending to the elongated interior and longitudinally along the handguard;

a first shoulder extending from the first sidewall and configured to receive a vertically extending first fastener;

a barrel nut including a midline bisecting the barrel nut into an upper portion and a lower portion, the barrel nut including a periphery, the barrel nut defining a first registration groove around the periphery of the barrel nut, the barrel nut sized to be positioned in the handguard interior adjacent the barrel;

a first connector bridge disposed in the first bridge slot, the first connector bridge including a first ramped surface configured to engage the first registration groove in the lower portion of the barrel nut below the midline, the first connector bridge oriented for engagement by the first fastener such that when the first fastener is tightened, the barrel nut is clamped between the first ramped surface and the elongated interior of the handguard;

a second shoulder extending from the first sidewall and configured to receive a vertically extending second fastener, the second fastener being distal from the first fastener;

a second registration groove around the periphery of the barrel nut; and a second ramped surface joined with the first connector bridge and configured to engage the second registration groove in the lower portion of the barrel nut below the midline, the first connector bridge oriented for engagement by the second fastener such that when the second fastener is tightened, the barrel nut is clamped between the second ramped surface and the elongated interior of the handguard.

3. The apparatus of claim 2 comprising:

a third shoulder extending from the second sidewall and configured to receive a vertically extending third fastener;

a second connector bridge disposed in a second bridge slot defined by the handguard, the second connector bridge including a third ramped surface configured to engage the first registration groove in the lower portion of the barrel nut below the midline, such that the first ramped surface and the third ramped surface can simultaneously be disposed in the first registration groove.

4. The apparatus of claim 3 comprising:

wherein the second connector bridge is oriented for engagement by the third fastener such that when the third fastener is tightened, the barrel nut is clamped between the third ramped surface and the elongated interior of the handguard.

5. The apparatus of claim 4 comprising:

a fourth shoulder extending from the second sidewall rearward of the third shoulder and configured to receive a vertically extending fourth fastener;

a fourth ramped surface joined with the second connector bridge and configured to engage the second registration groove in the lower portion of the barrel nut below the midline, the second connector bridge oriented for engagement by the fourth fastener such that when the fourth fastener is tightened, the barrel nut is clamped between the fourth ramped surface and the elongated interior of the handguard.

6. An apparatus for securing a handguard to a barrel nut of a firearm, comprising:

a barrel nut configured to be joined with a firearm receiver, the barrel nut having an outer surface that requires no indexing relative to the firearm receiver, the barrel nut defining a first registration groove extending around a longitudinal axis of the barrel nut;

a handguard including a first sidewall, the handguard defining a first fastener opening configured to receive a first fastener, the handguard defining a first lateral opening extending through the first sidewall;

a first connecting bridge disposed within the first lateral opening, the first connecting bridge including a first contact surface shaped to mate with the first registration groove of the barrel nut; and a second registration groove distal from the first registration groove with a plurality of tool lands disposed between the first registration groove and the second registration groove, wherein the first fastener is oriented vertically and configured to bias the first connection bridge into engagement with the barrel nut at the first registration groove.

7. The apparatus of claim 6, wherein the first connecting bridge includes a second contact surface shaped to mate with the second registration groove of the barrel nut, distal from the first contact surface.

* * * * *